US008077105B2

(12) United States Patent
Takahashi et al.

(10) Patent No.: US 8,077,105 B2
(45) Date of Patent: Dec. 13, 2011

(54) DIRECTIVE BAR-TYPE ANTENNA

(75) Inventors: Masayuki Takahashi, Tsurugashima (JP); Shuichi Ogata, Tsurugashima (JP); Masanori Eiri, Tsurugashima (JP); Kinya Kishita, Tsurugashima (JP); Satoru Kimura, Tsurugashima (JP)

(73) Assignee: Toko Inc., Tokyo (JP)

( * ) Notice: Subject to any disclaimer, the term of this patent is extended or adjusted under 35 U.S.C. 154(b) by 316 days.

(21) Appl. No.: 12/418,265

(22) Filed: Apr. 3, 2009

(65) Prior Publication Data

US 2009/0251376 A1 Oct. 8, 2009

(30) Foreign Application Priority Data

Apr. 4, 2008 (JP) ..... 2008-097872
Apr. 25, 2008 (JP) ..... 2008-114981

(51) Int. Cl.
*H01Q 7/08* (2006.01)

(52) U.S. Cl. ..... 343/788; 343/787

(58) Field of Classification Search ..... 343/787, 343/788

See application file for complete search history.

(56) References Cited

U.S. PATENT DOCUMENTS 3,623,116 A * 11/1971 Green et al. ..... 343/788
4,879,570 A * 11/1989 Takizawa et al. ..... 343/713
7,068,223 B2 * 6/2006 Yoshida et al. ..... 343/700 MS

FOREIGN PATENT DOCUMENTS

JP 07-221526 8/1995
JP 2002-217635 8/2002
JP 2007-065881 3/2007

* cited by examiner

*Primary Examiner* — Hoang V Nguyen
(74) *Attorney, Agent, or Firm* — Cozen O'Connor

(57) ABSTRACT

Disclosed is a directional bar-type antenna which comprising a plurality of bar-shaped antenna elements including a core and a coil wound around the core. The first bar-shaped antenna element is disposed at a position of a mirror image of the second bar-shaped antenna element with respect to the core of the third bar-shaped antenna element. The first and second bar-shaped antenna elements is positioned such that one end of each of the first and second bar-shaped antenna elements is close to the third bar-shaped antenna element, and the other end is far from the third bar-shaped antenna element. In the present invention, a winding direction of the coil of the first bar-shaped antenna element is preferably identical to that of the coil of the second bar-shaped antenna element, and is opposite to that of the coil of the third bar-shaped antenna element. The directional bar-type antenna of present invention can meet a need for providing asymmetrical directionality in a forward-rearward direction of an antenna for use in a specific system, such as a keyless entry system, and solve a problem in terms of cost and external appearance, in a technique of partially surrounding a bar-type antenna by a shielding member, in view of difficulty in freely controlling directionality of an antenna in an induced electromagnetic field domain, and a need to allow the bar-type antenna to have a difference between respective receiving sensitivities in forward and rearward directions in the induced electromagnetic field domain (while facilitating a reduction in size and cost).

4 Claims, 14 Drawing Sheets

| PARAMETER \ EXAMPLE | TEST 7 | TEST 8 | TEST 9 | TEST 10 | TEST 11 |
|---|---|---|---|---|---|
| θ [°] | 65 | 65 | 65 | 65 | 63 |
| d 2 [mm] | 0 | +4 | 0 | 0 | 0 |
| d 3 [mm] | 0 | 0 | −4 | 0 | 0 |
| N [TURNS] | 20 | 20 | 20 | 18 | 20 |
| D [mm] | 20 | 20 | 20 | 20 | 35 |
| DIRECTIVE SENSITIVITY [dB] | 9. 15 | 20. 15 | 12. 67 | 17. 01 | 43. 52 |

DIRECTIVE BAR-TYPE ANTENNA

BACKGROUND OF THE INVENTION

1. Field of the Invention

The present invention relates to a bar-type antenna having directionality.

2. Description of the Background Art

A conventional keyless entry system is configured to allow a user to lock or unlock a door of a vehicle or the like through user's manual operation of a button of a remote unit. In this system, a low-frequency (LF) band signal is used, and a bar-type antenna is employed in view of its capability for downsizing irrespective of a level of wavelength.

As is commonly known, a typical bar-type antenna has a FIG. 8 (eight)-shaped directional characteristic. FIG. 25(*a*) is a perspective view showing one example of a conventional bar-type antenna. As shown in FIG. 25(*a*), the bar-type antenna 40 comprises a bar-shaped core 41, and a coil 42 wound around a central portion of the core 41.

In the bar-type antenna illustrated in FIG. 25(*a*), the core 41 has a bar shape having the following size: length L×width W×thickness T=20 mm×10 mm×10 mm.

In FIG. 25(*a*), the origin O is a center point dividing in half each of the length L, the width W and the thickness T of the core 42. A lengthwise direction of the core 41, a widthwise direction of the core 41 and a thicknesswise direction of the core 41 will hereinafter be referred to respectively as "X axis", "Y axis" and "Z axis".

Further, a point located forward of the bar-type antenna at coordinate (X, Y, Z)=(1m, 0, 0), and a point located rearward of the bar-type antenna at coordinate (X, Y, Z)=(−1m, 0, 0) will hereinafter referred to respectively as "point A" and "point B".

The core 41 has the following properties: relative magnetic permeability $\mu_r$=80, and electrical conductivity $\sigma$=0 s/m. A wire having a diameter $\phi$ of 0.3 mm is wound around the central portion of the core 41 by 20 turns, to form the coil 42.

FIG. 26 is a graph showing a magnetic field intensity distribution in an X-Y plane in a state when an AC current source I (see FIG. 25(*b*)) is connected to the coil 42 of the bar-type antenna 40 illustrated in FIG. 25(*a*). The AC current source I is set as follows: frequency f=125 kHz, and current value i=2 $A_{pp}$.

In this case, respective magnetic field intensities at the A and B points are as follows: the point A: A=1.53×$10^{-3}$ A/m, and the point B: B=1.51×$10^{-3}$ A/m. A directional sensitivity (20×log(A/B)) is 0.10 dB, and thereby there is substantially no directionality.

As above, the magnetic field intensity distribution is symmetrical with respect to each of the axes of the core 41, and thereby the conventional bar-type antenna has no directional sensitivity in an axial direction of the core 41. In this connection, the following Patent Document 1 discloses a technique of combining a plurality of bar-shaped antenna elements to provide a non-directional antenna.

As a recent keyless entry system, there has been known a smart entry system configured to allow a driver to automatically unlock a door of a vehicle simply by approaching the vehicle while carrying a remote unit, and to automatically lock the door simply by getting out of the vehicle and moving away from the vehicle. Recent years, the smart entry system has also been employed in a front door of a house.

In the smart entry system, if a conventional antenna is arranged to have a receiving sensitivity in an outward direction relative to a door, the antenna will also have a receiving sensitivity in an inward direction relative to the door. Thus, in cases where the conventional bar-type antenna is employed in the smart entry system for a front door of a house, there is a problem that the front door is unlocked even when a person who carries a remote unit within the house approaches the front door to check a visitor. Therefore, in order to avoid such an unintended unlock, it is necessary to provide a difference between the respective receiving sensitivities in the outward and inward directions relative to the door. As one technique of providing such a difference in receiving sensitivity when the conventional bar-type antenna is employed in the above smart entry system, a shielding member 6 is installed in a direction from which a bar-type antenna 5 should not receive electromagnetic waves, as shown in FIG. 27.

[Patent Document 1] JP 2002-217635A

[Patent Document 2] JP 3495401B

[Patent Document 3] JP 2007-065881A

In a specific system, such as a keyless entry system, an antenna is required to have asymmetrical directionality in a forward-rearward direction thereof in some cases.

In cases where a communication distance is sufficiently greater than a wavelength, communication is performed in a radiation electromagnetic field domain, so that directionality of an antenna can be freely controlled using a conventional technique.

Even in short-distance communication, as long as the communication is performed using a high-frequency band, i.e., in a short-wavelength region, the communication is performed in the radiation electromagnetic field domain. However, in a short-distance wireless communication system using a low-frequency band, such as a keyless entry system or a smart entry system, a wavelength is significantly long as compared with a communication distance. Thus, communication is performed in an induced electromagnetic field domain.

In the induced electromagnetic field domain, it is difficult to freely control directionality of an antenna. Moreover, although a bar-type antenna may be partially surrounded by a shielding member when it is necessary to allow the bar-type antenna to have a difference between respective receiving sensitivities in forward and rearward directions in the induced electromagnetic field domain, such a technique involves a problem in terms of cost and external appearance.

SUMMARY OF THE INVENTION

It is an object of the present invention to provide a directional bar-type antenna capable of exhibiting directionality in a specific direction without using a shield. It is another object of the present invention to provide a directional bar-type antenna capable of facilitating a reduction in cost and size.

In order to achieve the above objects, the present invention provides a directional bar-type antenna, which comprises a plurality of bar-shaped antenna elements including a core and a coil wound around the core, wherein the first bar-shaped antenna element is disposed at a position of a mirror image of the second bar-shaped antenna element with respect to the core of the third bar-shaped antenna element, and the first and second bar-shaped antenna elements is positioned such that one end of each of the first and second bar-shaped antenna elements is close to the third bar-shaped antenna element, and the other end is far from the third bar-shaped antenna element.

Preferably, in the directional bar-type antenna of the present invention, a winding direction of the coil of the first bar-shaped antenna element is identical to that of the coil of the second bar-shaped antenna element, and is opposite to that of the coil of the third bar-shaped antenna element.

The directional bar-type antenna of the present invention has an asymmetrical directional characteristic in a forward-rearward direction thereof. Thus, the directional bar-type antenna can exhibit directionality in a specific direction, while facilitating a reduction in cost and size.

DESCRIPTION OF THE PREFERRED EMBODIMENTS

Figure 1:
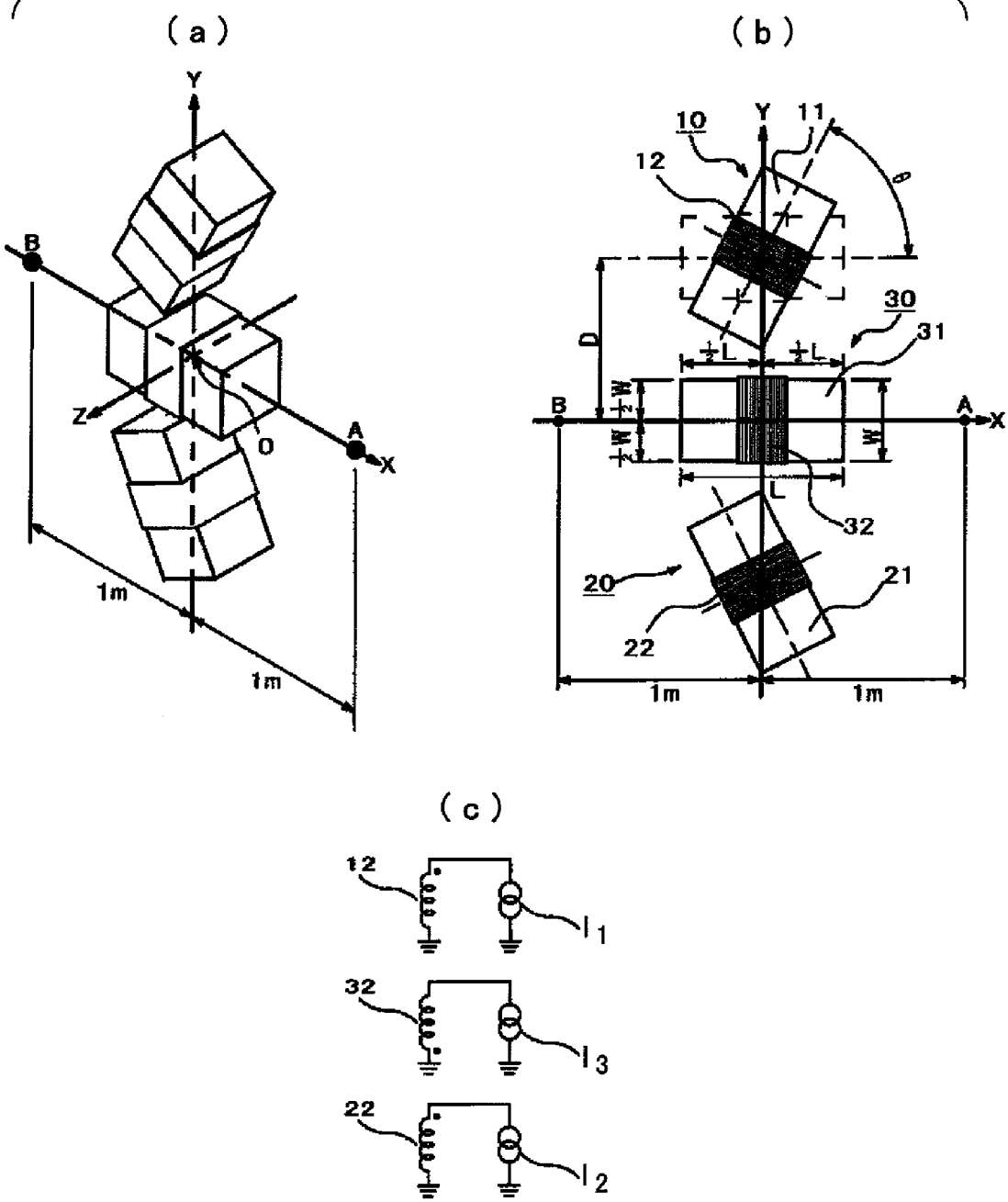
FIGS. 1(*a*) to 1(*c*) illustrate a directional bar-type antenna according to a first embodiment of the present invention.

With reference to FIGS. 1(*a*) to 1(*c*), a directional bar-type antenna according to a first embodiment of the present invention will be described. FIG. 1(*a*) is a perspective view showing the directional bar-type antenna according to the first embodiment. FIG. 1(*b*) is a top plan view showing an arrangement of bar-shaped antenna elements, and FIG. 1(*c*) is an equivalent circuit diagram showing a connection of a coil.

As shown in FIGS. 1(*a*) to 1(*c*), a bar-shaped antenna element 10 includes a core 11, and a coil 12 wound around a central portion of the core 11. In the same manner, a bar-shaped antenna element 20 includes a core 21, and a coil 22 wound around a central portion of the core 21, and a bar-shaped antenna element 30 includes a core 31, and a coil 32 wound around a central portion of the core 31.

As shown in FIG. 1(*b*), the bar-shaped antenna elements 10, 20 are symmetrically arranged with respect to the bar-shaped antenna element 30, in such a manner that a first one of opposite ends of each of the bar-shaped antenna elements 10, 20 is located adjacent to the bar-shaped antenna element 30, and the other second end is located farther away from the bar-shaped antenna element 30 than the first end. More specifically, each of the cores 11, 21 is arranged such that a center thereof is located in spaced-apart relation to a center of the core 31 by a distance 1). Further, and each of the cores 11, 21 is rotated about the center thereof in an X-Y plane in an opposite direction by an angle θ. The broken line in FIG. 1(*b*) indicates a position of the bar-shaped antenna 10 when the angle θ is set at zero degree. In FIGS. 1(*a*) and 1(*b*), an origin O of an X Y Z coordinate system is set at the center of the core 31, and a lengthwise direction of the core 31, a widthwise direction of the core 31 and a thicknesswise direction of the core 31 are set to be aligned, respectively, with an X-axis direction, a Y-axis direction and a Z-axis direction. Further, a point A is set at a position forwardly away from the bar-antenna element 30 by 1 m, i.e., at a coordinate position (x, y, z)=(1, 0, 0), and a point B set at a position rearwardly away from the bar-antenna element 30 by 1 m, i.e., at a coordinate position (x, y, z)=(−1, 0, 0). In FIG. 1(*c*), each of the codes $I_1$ to $I_3$ indicates an AC current source, and each of the black circles indicates a winding direction (polarity) of a corresponding one of the coils 12, 22, 32. That is, the winding direction of the coil 12 is set to be identical to that of the coil 22 and opposite to that of the coil 32.

Figure 2:
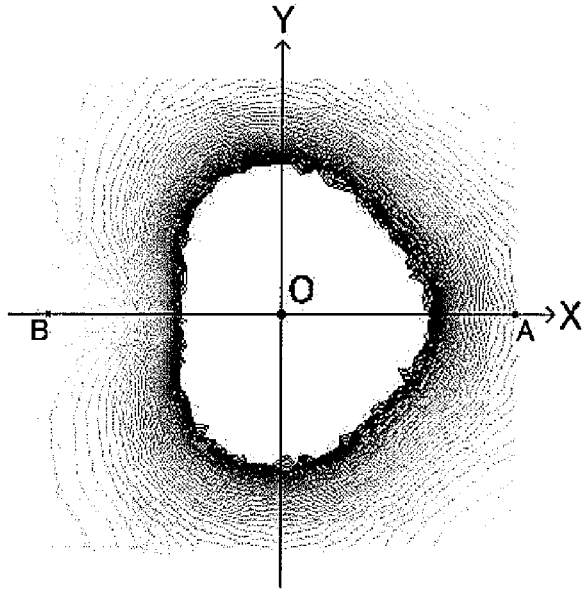
FIG. 2 is a graph showing a magnetic field intensity distribution in the directional bar-type antenna illustrated in FIGS. 1(*a*) to 1(*c*).

FIG. 2 shows a magnetic field intensity distribution in the X-Y plane obtained when parameters of the directional bar-type antenna are set as follows:

length $L$×width $W$×thickness $T$ of each of the cores 11, 21, 31=20 mm×10 mm×10 mm;

D=20 mm;

θ=63 degrees;

the number of turns of each of the coils 12, 22, 32=20;

wire diameter ϕ of each of the coils 12, 22, 32=0.3 mm;

relative magnetic permeability $\mu_r$ of each of the cores 11 21, 31=80;

current value i of each of the AC current sources $I_1$ to $I_3$=1 $A_{pp}$; and frequency f of each of the AC current sources $I_1$ to $I_3$=125 kHz.

In this case, respective magnetic field intensities at the points A, B located forwardly and rearwardly away from the bar-antenna element 30 by 1 m were as follows:

point A: $2.21\times10^{-4}$ A/m; and point B: $2.59\times10^{-5}$ A/m.

As above, the directional bar-type antenna according to the first embodiment exhibits a relatively high sensitivity in a frontward direction thereof, and a relatively low sensitivity in a rearward direction thereof.

(Experimental Test 1)

Figure 3:
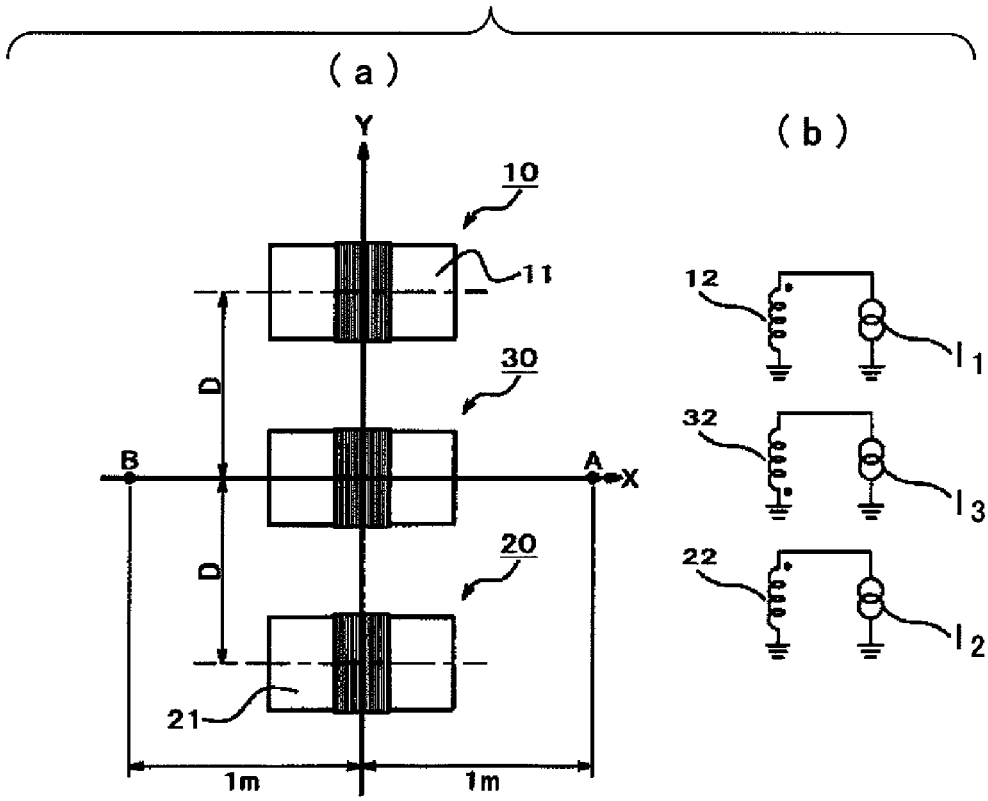
FIGS. 3(*a*) and 3(*b*) illustrate a bar-type antenna for an experimental test 1, wherein an angle θ in the bar-type antenna illustrated in FIG. 1(*b*) is set at zero degree.

FIGS. 3(*a*) and 3(*b*) illustrate a bar-type antenna for an experimental test 1, wherein the angle θ in the bar-type antenna illustrated in FIG. 1(*b*) is set at zero degree. FIG. 3(*a*) is a top plan view showing an arrangement of the bar-shaped antenna elements thereof, and FIG. 3(*b*) is an equivalent circuit diagram showing a connection of the coils thereof.

As shown in FIG. 3(*a*), the three bar-shaped antenna elements 10, 20, 30 are arranged in parallel to each other. Further, as shown in FIG. 3(*b*), the winding direction of the coil 12 is set to be identical to that of the coil 22 and opposite to that of the coil 32.

Figure 4:
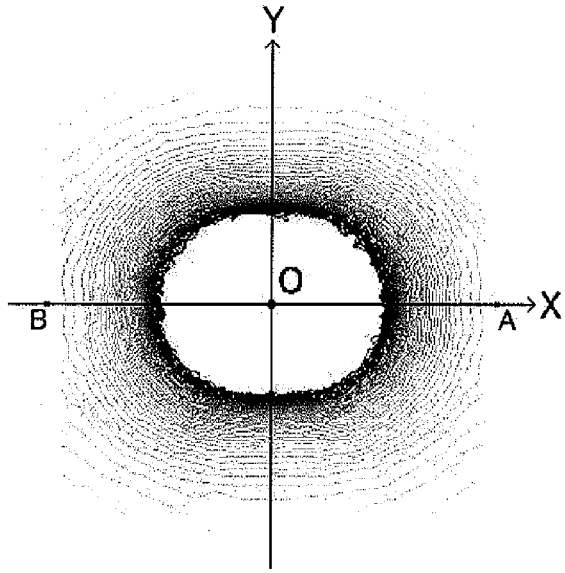
FIG. 4 is a graph showing a magnetic field intensity distribution in the bar-type antenna illustrated in FIGS. 3(*a*) and 3(*b*).

FIG. 4 shows a magnetic field intensity distribution in the X-Y plane in the bar-type antenna illustrated in FIGS. 3(*a*) and 3(*b*).

In this case, respective magnetic field intensities at the points A, B were as follows:

point A: $1.53\times10^{-3}$ A/m; and point B: $1.52\times10^{-3}$ A/m and a directional sensitivity was 0.05 dB. That is, this bar-type antenna exhibited substantially no directionality.

(Experimental Test 2)

Figure 5:
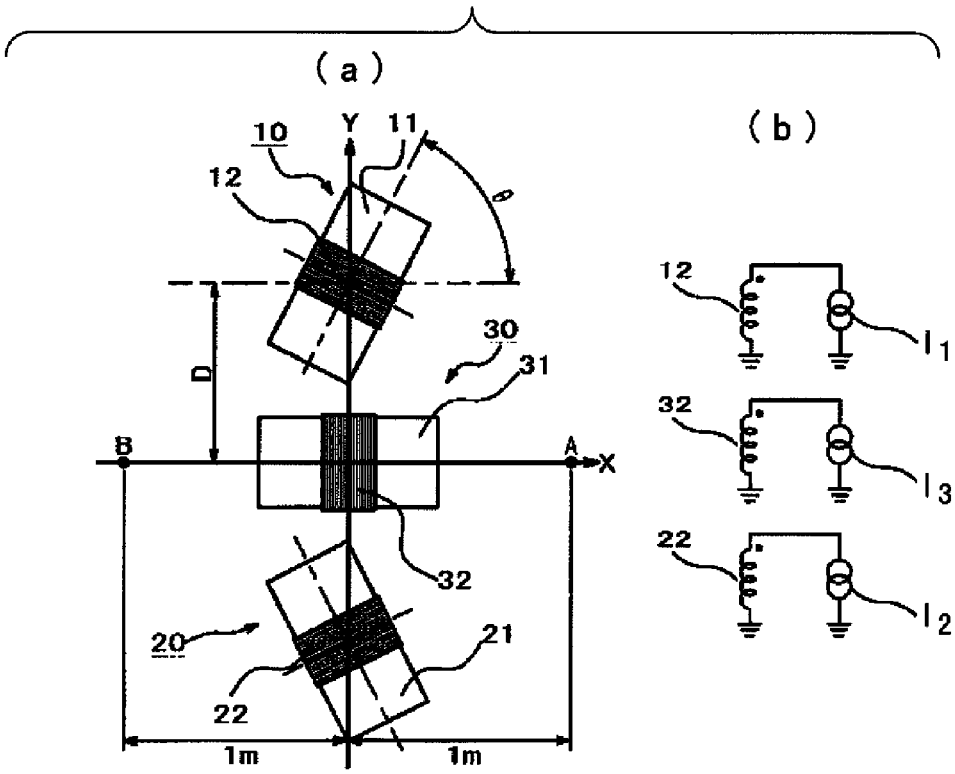
FIGS. 5(*a*) and 5(*b*) illustrate a bar-type antenna for an experimental test 2, wherein respective winding directions of three coils in the bar-type antenna illustrated in FIG. 1(*b*) are set to be identical to each other.

FIGS. 5(*a*) and 5(*b*) illustrate a bar-type antenna for an experimental test 2, wherein the respective winding directions of the coils 12, 22, 32 of the bar-type antenna illustrated in FIG. 1(*b*) are set to be identical to each other. FIG. 5(*a*) is a top plan view showing an arrangement of the bar-shaped antenna elements thereof, and FIG. 3(*b*) is an equivalent circuit diagram showing a connection of the coils thereof.

As shown in FIG. 5(*a*), the bar-shaped antenna elements 10, 20 are symmetrically arranged with respect to the bar-shaped antenna element 30, in such a manner that the first end of each of the bar-shaped antenna elements 10, 20 is located adjacent to the bar-shaped antenna element 30, and the second end is located farther away from the bar-shaped antenna element 30 than the first end. Further, as shown in FIG. 5(*b*), the respective winding directions of the coils 12, 22, 32 are identical to each other.

Figure 6:
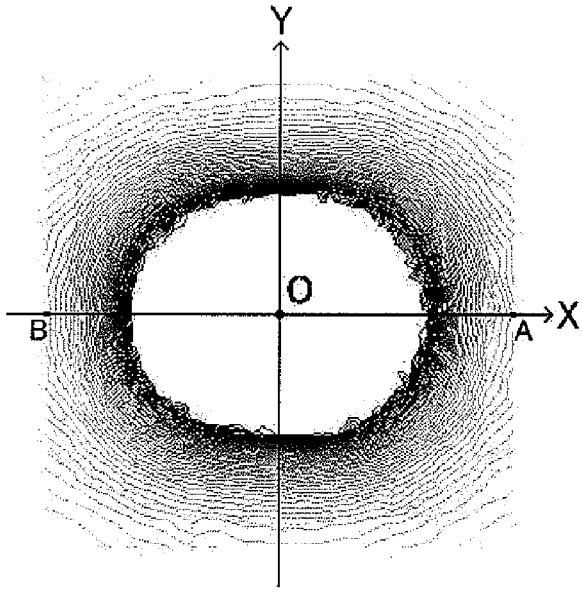
FIG. 6 is a graph showing a magnetic field intensity distribution in the bar-type antenna illustrated in FIGS. 5(*a*) and 5(*b*).

FIG. 6 shows a magnetic field intensity distribution in the X-Y plane in the bar-type antenna illustrated in FIGS. 5(*a*) and 5(*b*).

In this case, respective magnetic field intensities at the points A, B were as follows:

point A: $2.72\times10^{-3}$ A/m; and point B: $2.69\times10^{-3}$ A/m and a directional sensitivity was 0.11 dB. That is, this bar-type antenna exhibited substantially no directionality.

(Experimental Test 3)

Figure 7:
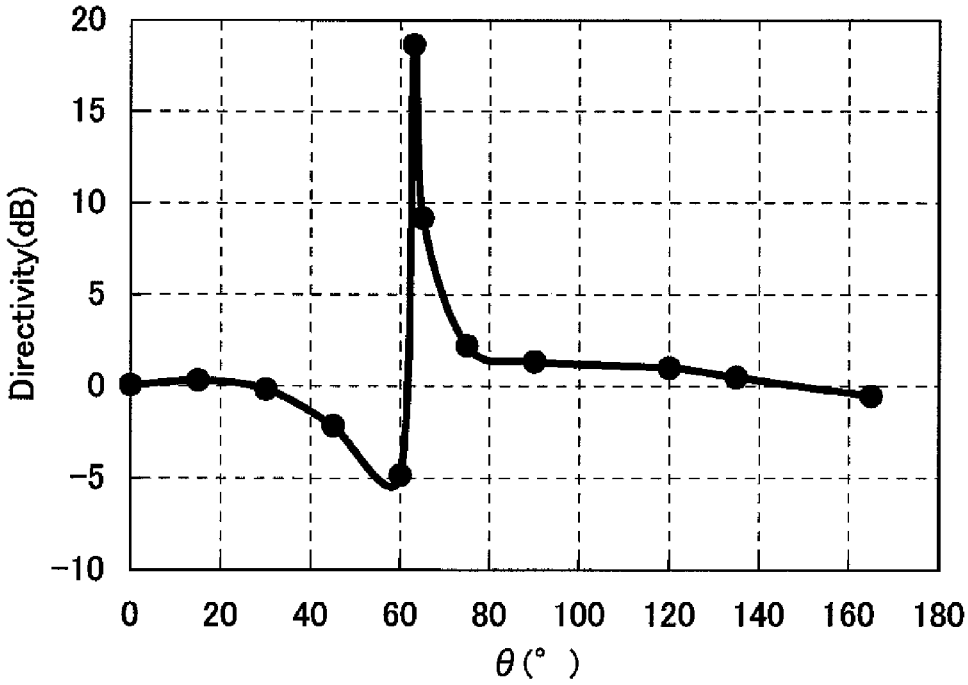
FIG. 7 is a graph showing a change in directional sensitivity obtained in an experimental test 3 by changing the angle θ in FIG. 1 in the range of zero to 180 degrees.

FIG. 7 is a graph showing a change in directional sensitivity obtained in an experimental test 3 by changing the angle θ between the core 31 and each of the cores 11, 12 in the range of zero to 180 degrees, wherein the horizontal axis represents the angle θ, and the vertical axis represents the directional sensitivity.

As seen in FIG. 7, almost no directionality is obtained when the angle θ is about zero degree, i.e., the three cores are arranged in parallel to each other, whereas, when the angle θ is in the range of greater than zero degree to less than 90 degree, the directional sensitivity is increased to a maximum value of 18 dB at an angle θ of 63 degrees to provide a sharp directionality in the forward direction.

A state when the angle θ is 90 degrees or more is equivalent to a state when each of the winding directions of the coils 12, 22 is reversed, and thereby the respective winding directions of the coils 12, 22, 32 become identical to each other. In this state, the directional sensitivity becomes almost zero dB, i.e., no directionality is obtained.

As is evidenced by the above test results, a desired effect can be obtained when the bar-shaped antenna elements 10, 20 are symmetrically arranged with respect to the bar-shaped antenna element 30, in such a manner that the first end of each of the bar-shaped antenna elements 10, 20 is located adjacent to the bar-shaped antenna element 30, and the second end is located farther away from the bar-shaped antenna element 30 than the first end, and the winding direction of the bar-shaped antenna element 10 is set to be identical to that of the bar-shaped antenna element 20 and opposite to that of the bar-shaped antenna element 30.

In the first embodiment illustrated in FIGS. 1(*a*) to 1(*c*), each of the coils 12, 22 is set to have the same driving current value, the same number of turns, the same distance D from the core 31, and the same magnetic permeability If at least one of the parameters is changed, a direction of directionality will be changed. Thus, directionality can be readily adjusted by utilizing this characteristic, for example, by adjusting the driving current value of each of the coils 12, 22. Further, this bar-type antenna can be used as an adaptive antenna by positively adjusting the driving current value. A functional or geometric symmetry is likely to be lost due to a variation in properties of each of the cores 11, 21, such as a variation in material thereof, and a manufacturing error, such as a deviation in winding position of each of the coils. In this case, the driving current value of each of the coils can be adjusted to correct the symmetry. If it is permitted to set the driving current for each of the three coils at the same value, the coils may be connected in series to each other, and driven by a single current source.

(Experimental Test 4)

Figure 8:
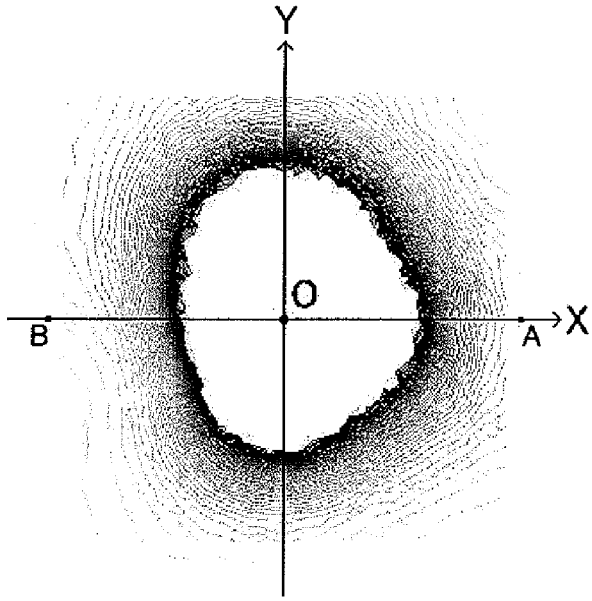
FIG. 8 is a graph showing a magnetic field intensity distribution in an experimental test 4, wherein the number of turns of one of the coils of the bar-type antenna illustrated in FIG. 1 is set to be different from that of each of the remaining coils.

FIG. 8 is a graph showing a magnetic field intensity distribution in the X-Y plane in an experimental test 4, wherein the number of turns of the coil 12 of the bar-type antenna illustrated in FIG. 1 is changed from 20 to 21.

(Experimental Test 5)

Figure 9:
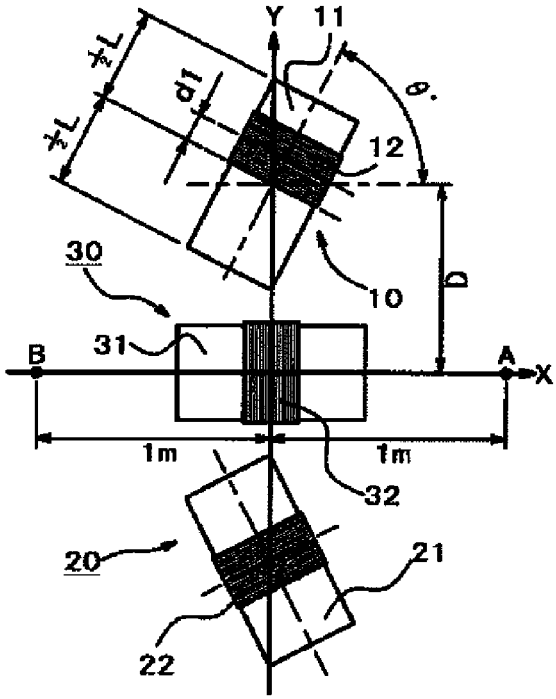
FIG. 9 is a schematic diagram showing a bar-type antenna for an experimental test 5, wherein a winding position of an outer one of the coils of the bar-type antenna illustrated in FIG. 1 is set to be different from that of each of the remaining coils.
Figure 10:
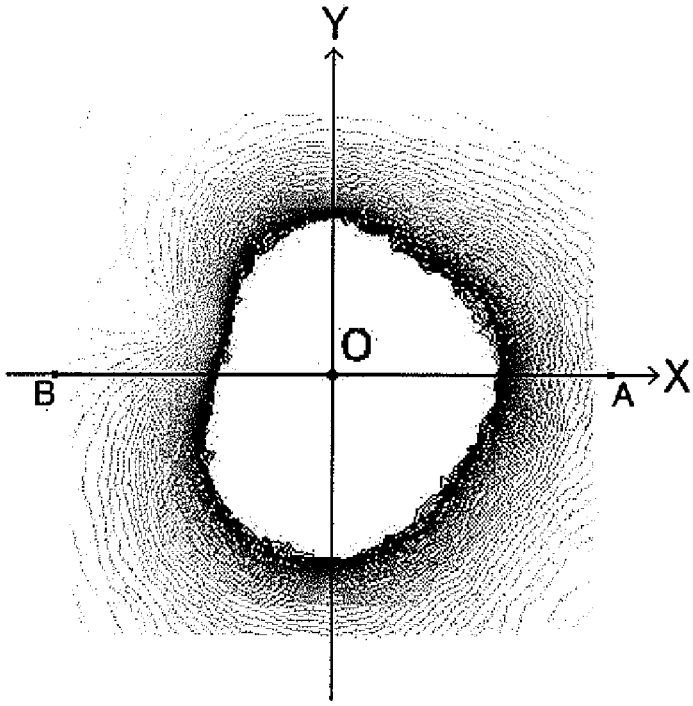
FIG. 10 is a graph showing a magnetic field intensity distribution in the bar-type antenna illustrated in FIG. 9.

FIG. 9 is a schematic diagram showing a bar-type antenna for an experimental test 5, wherein a winding position of the coil 12 of the bar-type antenna illustrated in FIG. 1 is displaced from the center thereof toward the second end thereof by a distance d1 of 3 mm. FIG. 10 shows a magnetic field intensity distribution in the X-Y plane in the bar-type antenna illustrated in FIG. 9.

(Experimental Test 6)

Figure 11:
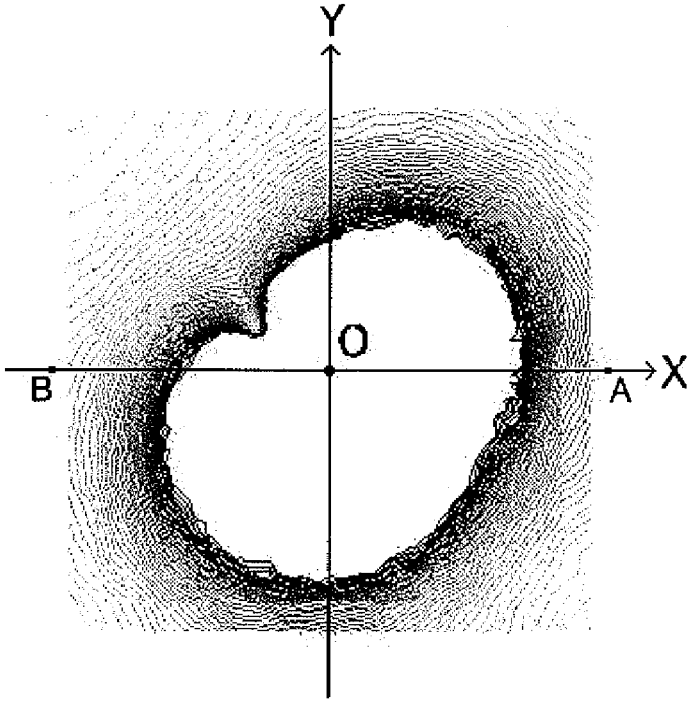
FIG. 11 is a graph showing a magnetic field intensity distribution in an experimental test 6, wherein a driving current value of an outer one of the coils of the bar-type antenna illustrated in FIG. 1 is set to be different from that of each of the remaining coils.

FIG. 11 shows a magnetic field intensity distribution in the X-Y plane in an experimental test 6, wherein the driving current value i of the coil 12 of the bar-type antenna illustrated in FIG. 1 is changed from 1.0 A to 0.8 A.

As seen in the results of the tests 4 to 6, directionality can be changed by setting at least one of the number of turns, the winding position and the driving current value of the coil 12 to be different from that of the coil 22.

(Experimental Tests 7 to 11)

Figures 12, 13:
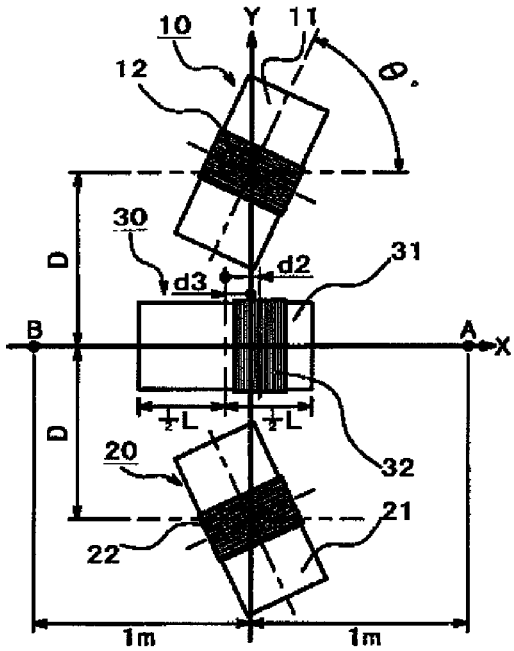
FIG. 12 is an explanatory diagram showing an arrangement of a core and a coil of a bar-shape antenna element for experimental tests 7 to 11.
FIG. 13 is a table showing a change in directional sensitivity obtained in the experimental tests 7 to 11 by changing various parameters in FIG. 12.

FIG. 12 is an explanatory diagram showing the winding position of the coil 32 and the position of the core 31 of the bar-shaped element 30 for experimental tests 7 to 11. In FIG. 12, the code d2 indicates a distance between the center of the core 31 and a center of a winding of the coil 32, and the code d3 indicates a distance from the origin O to the center of the core 31 in the X-axis direction. That is, when d3=zero, the center of the core 31 becomes coincident with the origin O. In regard to the distances d2, d3, a positive value is given to a rightward (in FIG. 12) distance along the X-axis.

FIG. 13 shows a directional sensitivity at each of the point A and the point B obtained when the following parameters in FIG. 12 are changed:

(1) the angle θ between the core 31 and each of the cores 11, 21:

(2) the winding position d2 of the coil 32;

(3) the position d3 of the core 31;

(4) the number of turns of the coil 32; and (5) the distance D between the center of the core 31 and the center of each of the cores 11, 21.

As seen in the result in the table of FIG. 13, a directional sensitivity can be changed by changing at least one of the angle θ between the core 31 and each of the cores 11, 21, the winding position d2 of the coil 32, the position d3 of the core 31, the number of turns of the coil 32, and the distance D between the center of the core 31 and the center of each of the cores 11, 21.

The first ends of the bar-shaped antenna elements 10, 20 adjacent to the bar-shaped antenna element 30 in FIG. 1 may be connected together by means of a rod-shaped connecting core.

Figure 14:
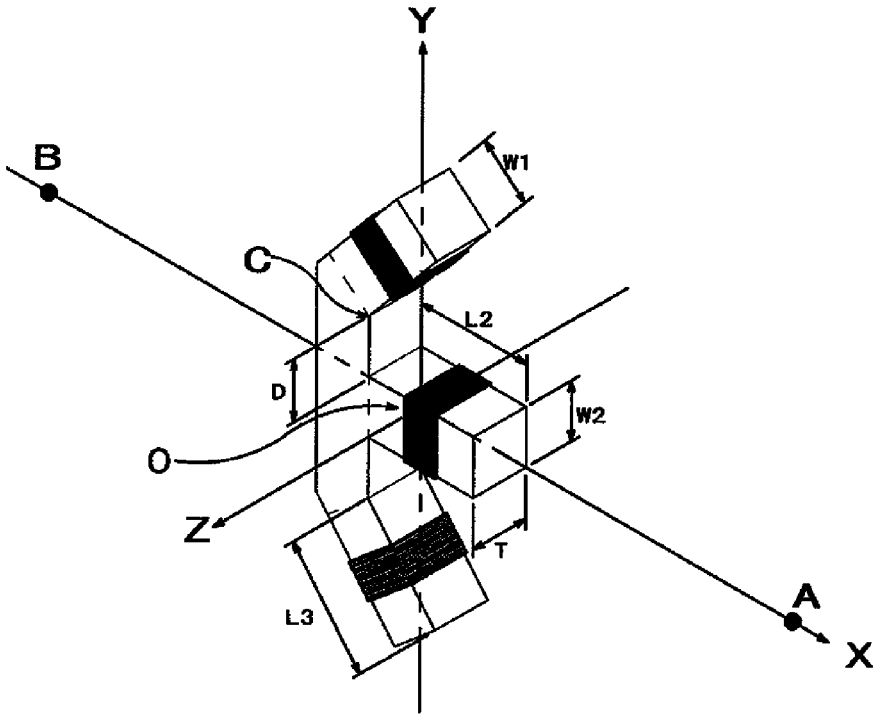
FIG. 14 is a perspective view showing a directional bar-type antenna according to a second embodiment of the present invention.

Specifically, FIG. 14 shows a directional bar-type antenna according to a second embodiment of the present invention. This directional bar-type antenna comprises: an E-shaped core unit which includes an inner magnetic leg (bar-shaped inner core), two first and second outer magnetic legs (bar-shaped outer cores) disposed on respective opposite sides of the inner magnetic leg, and a rod-shaped connecting core connected to a first one of opposite ends of the inner magnetic leg and a first one of opposite ends of each of the first and second outer magnetic legs; and three coils 1, 2, 3 wound around respective ones of the inner magnetic leg and the first and second outer magnetic legs. One pair of ends of the first and second outer magnetic legs are close each other, while the other are open, such that the first and second outer magnetic legs form radial shape.

Each of the coils 1, 3 is wound around a central portion of a corresponding one of the first and second outer magnetic legs located between a connection point C and the other second end thereof. The coil 2 is wound around a central portion of the inner magnetic leg. In FIG. 14, the point O indicates an origin of an XYZ coordinate system, and an axial direction of the inner magnetic leg, an axial direction of the rod-shaped connecting core and a thicknesswise direction of the rod-shaped connecting core are set to be aligned, respectively with an X-axis, a Y-axis and a Z-axis.

Figure 15:
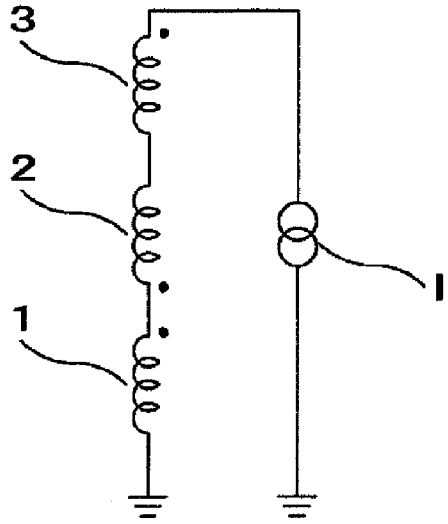
FIG. 15 is an equivalent circuit diagram showing a connection of three coils of the directional bar-type antenna illustrated in FIG. 14.

FIG. 15 is an equivalent circuit diagram showing a connection of the coils. The coils 1, 2, 3 are wound around the first outer magnetic leg, the inner magnetic leg and the second magnetic leg in this order, in such a manner that a winding direction of the coil 1 is set to be identical to that of the coil 3 and opposite to that of the coil 2. In FIG. 15, the code I indicates an AC current source, and each of the black circles indicates a winding start position of a corresponding one of the coils.

Figure 16:
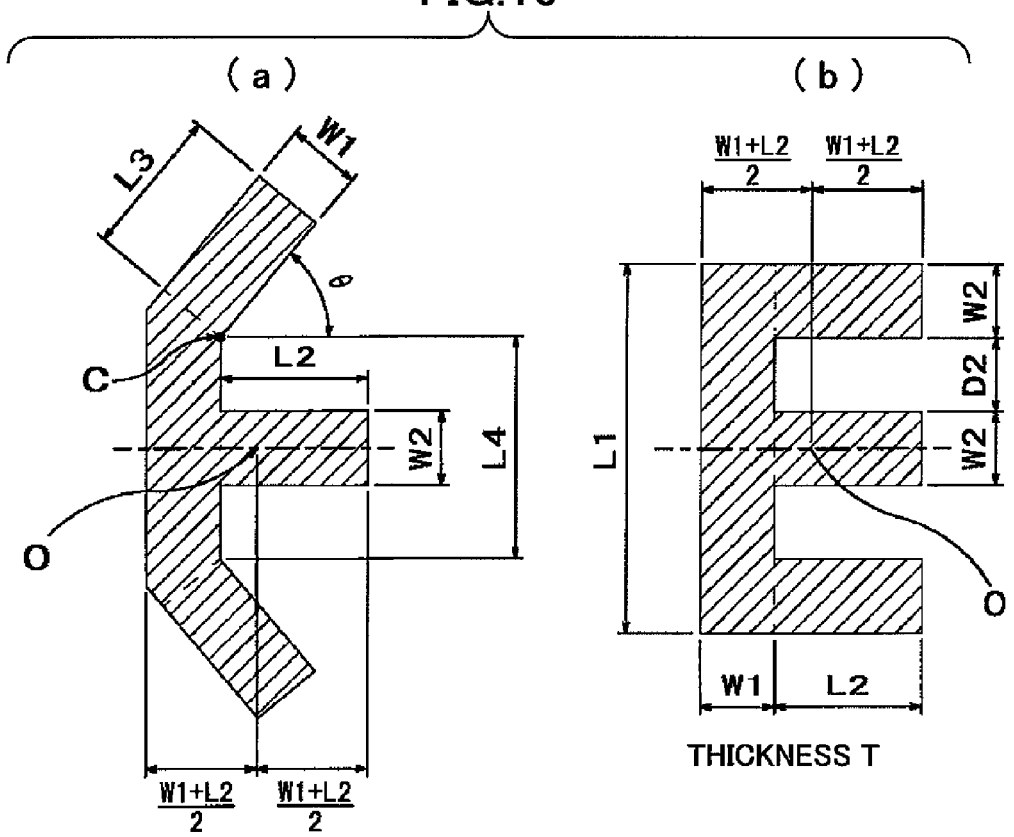
FIGS. 16(*a*) and 16(*b*) are sectional views showing a core unit of the directional bar-type antenna illustrated in FIG. 14, and a core unit to be obtained when an angle θ in FIG. 16(*a*) is set at zero.

FIG. 16(*a*) is a sectional view showing the core unit of the directional bar-type antenna illustrated in FIG. 14, and FIG. 16(*b*) is a sectional view showing a core unit to be obtained when an angle θ in FIG. 16(*a*) is set at zero.

(Experimental Test 12)

Figure 17:
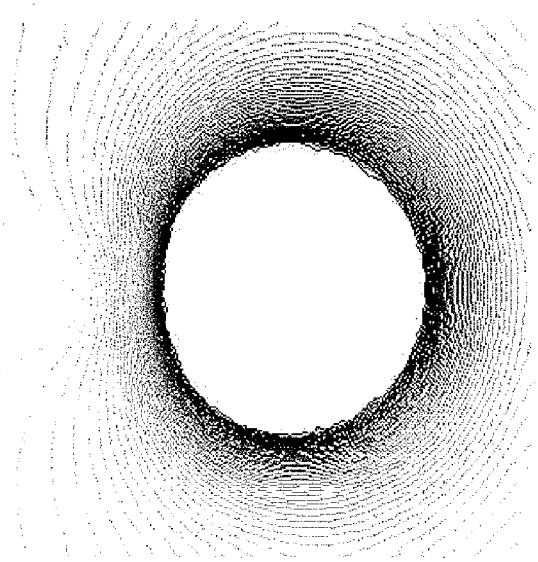
FIG. 17 is a graph showing a magnetic field intensity distribution in the directional bar-type antenna illustrated in FIG. 14.

FIG. 17 shows a magnetic field intensity distribution in the X-Y plane obtained when parameters of the directional bar-type antenna illustrated in FIG. 14 are set as follows:

rod-shaped connecting core (L1×W1×T)=50 mm×10 mm×10 mm;

inner magnetic leg (L2×W2×T)=20 mm×10 mm×10 mm;

outer magnetic leg (L2×W2×T)=20 mm×10 mm×10 mm;

angle θ between the inner magnetic leg and each of the outer magnetic legs=50 degrees;

distance L4 between the connection points C=30 mm;

relative magnetic permeability $\mu_r$ of the core unit=80;

the number of turns of each of the coils=20;

wire diameter ϕ of each of the coils=0.3 mm;

frequency f of the AC current source I=125 kHz; and current value i of the AC current source I=1 $A_{pp}$.

In FIG. 17, a horizontal direction is the X-axis, and a vertical direction is the Y-axis.

In this case, respective magnetic field intensities at the points A, B were as follows:

point A: $2.75\times10^{-2}$ A/m; and point B: $2.79\times10^{-3}$ A/m and a directional sensitivity was 19.89 dB.

As above, the directional bar-type antenna according to the second embodiment exhibits a relatively high sensitivity in a frontward direction thereof, and a relatively low sensitivity in a rearward direction thereof.

(Experimental Test 13)

Figure 18:
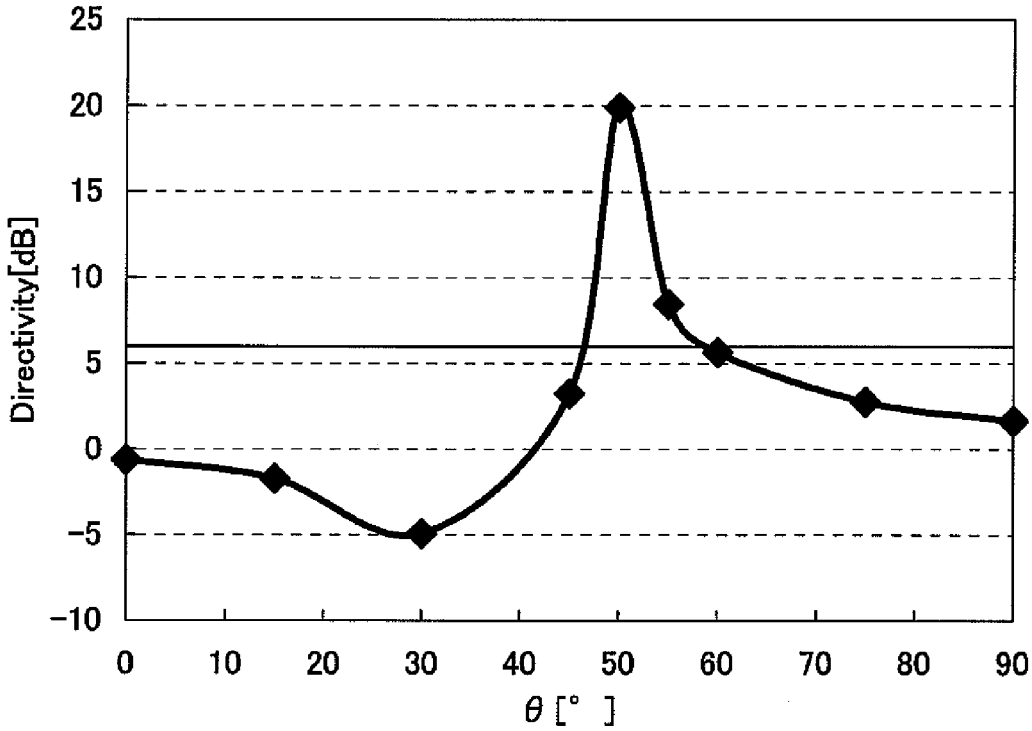
FIG. 18 is a graph showing a change in directional sensitivity obtained in an experimental test 13 by changing the angle θ in FIG. 1 in the range of zero to 180 degrees.

FIG. 18 is a graph showing a result of a test on an influence of the angle θ between the inner magnetic leg and each of the outer magnetic legs, on a directional sensitivity, wherein the horizontal axis represents the angle θ (degree) between the inner magnetic leg and each of the outer magnetic legs, and the vertical axis represents the directional sensitivity (dB). As is evidenced by this result, directional sensitivities at respective positions forwardly and rearwardly away from the bar-type antenna by 1 m are dependent on the angle θ between the inner magnetic leg and each of the outer magnetic legs.

As seen in the graph of FIG. 18, the directional sensitivity is almost zero dB when the angle θ is zero degree (core unit in FIG. 16(*b*)). Then, along with an increase in the angle θ, a directional sensitivity toward the point B rearward of the bar-type antenna is exhibited, and increased to a maximum value of 5 dB at an angle θ of about 30 degrees. Then, when the angle θ is further increased, the directional sensitivity is reversed at an angle θ of 40 degrees, and a directional sensitivity toward the point A forward of the bar-type antenna is exhibited. The directional sensitivity toward the frontward point A is sharply increased at an angle θ of 45 degrees or more, and a maximum value of 20 dB is obtained at an angle θ of 50 degrees. Then, when the angle θ is further increased, the directional sensitivity is gradually lowered to about 6 dB at an angle θ of 60 degrees and to about zero dB at an angle θ of 90 degrees. The angle θ providing the maximum directional sensitivity varies according to the position of each of the point A and the point B.

(Experimental Test 14)

Figure 19:
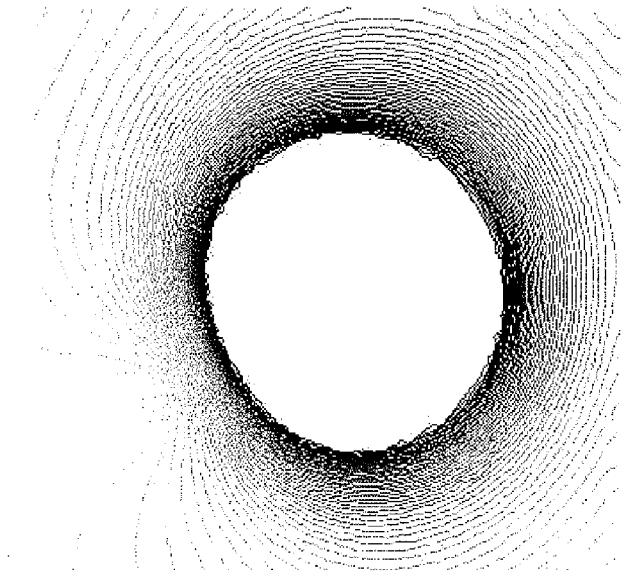
FIG. 19 is a graph showing a magnetic field intensity distribution in an experimental test 14.

FIG. 19 shows a magnetic field intensity distribution obtained when the number of turns of the coil 1 is set at 21, and the number of turns of each of the coils 2, 3 is set at 20, in the experimental test 12.

As is evidenced by the result in FIG. 19, when the number of turns of the first outer magnetic leg is set to be different from that of the second outer magnetic leg, directionality is moved toward one of the outer magnetic legs having a larger number of turns. Thus, a desired directionality can be achieved by adjusting the number of turns of each of the coils.

(Experimental Test 15)

Figure 20:
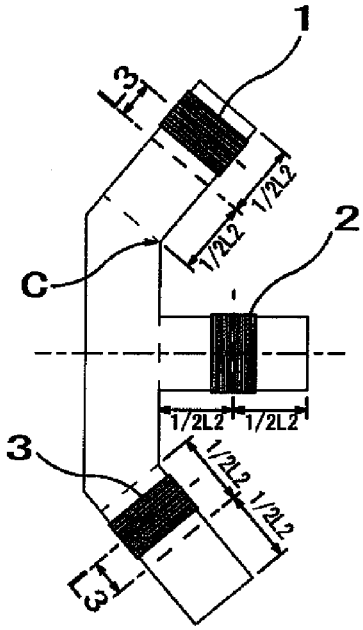
FIG. 20 is a schematic diagram showing respective winding positions of the coils in an experimental test 15.
Figure 21:
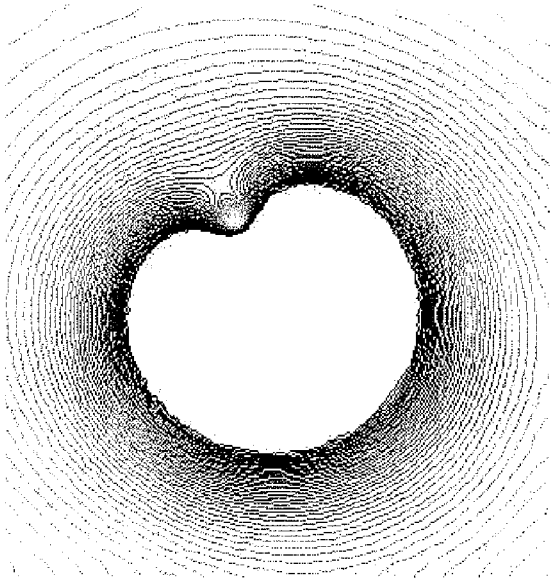
FIG. 21 is a graph showing a magnetic field intensity distribution in an experimental test 15.

FIG. 20 is a schematic diagram showing a bar-type antenna for an experimental test 15, wherein, given that the length between the connection point C and the second end of each of the outer magnetic legs is L2, and the center of each of the outer magnetic legs is L2/2, the winding position of the coil 1 in the experimental test 12 is displaced toward the second end of the first outer magnetic leg by a distance L3 of 5 mm, and the winding position of the coil 3 in the experimental test 12 is displaced toward the connection point C of the second outer magnetic leg by a distance L3 of 5 mm. FIG. 21 shows a magnetic field intensity distribution in the bar-type antenna illustrated in FIG. 20.

As is evidenced by the result in FIG. 21, when the winding position of the coil of the first outer magnetic leg is set to be different from that of the coil of the second outer magnetic leg, directionality is moved toward one of the outer magnetic legs having a coil wound at a position farther away from the second end. Thus, a desired directionality can be achieved by adjusting the winding position of each of the coils, as with the technique described in the experimental test 14.

(Experimental Test 16)

Figure 22:
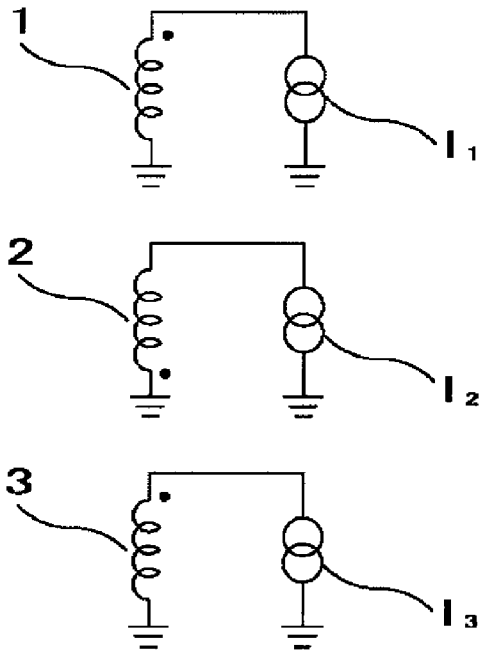
FIG. 22 is a circuit diagram showing a connection of a current source in an experimental test 16.

As one example of modification of the directional bar-type antenna according to the second embodiment, the coils 1, 2, 3 are connected to independent AC current sources $I_1$, $I_2$, $I_3$, respectively, as shown in FIG. 22.

Figure 23:
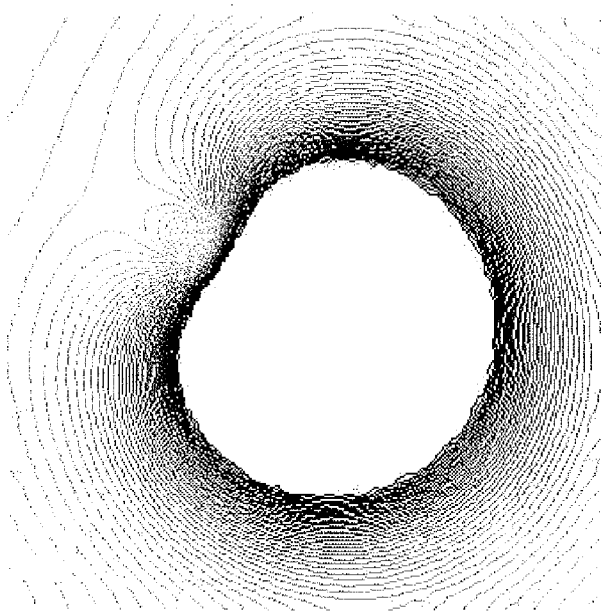
FIG. 23 is a graph showing a magnetic field intensity distribution in the experimental test 16.

FIG. 23 shows a magnetic field intensity distribution in the X-Y plane obtained when respective current values $i_1$, $i_2$, $i_3$ of the AC current sources $I_1$, $I_2$, $I_3$ are set as follows: $i_1$=0.9 A; $i_2$=1.0 A; and $i_3$=1.0 A. As is evidenced by the result in FIG. 23, directionality is moved toward one of the coils having a larger driving current value. Thus, directionality can be controlled by adjusting the driving current value of each of the coils.

In the core unit, a protruding direction of the inner magnetic leg may be set to be opposite to that of the outer magnetic legs to obtain the same effects.

The adjustment of directionality may be performed by setting at least one of the number of turns and the winding position of the coil of the first outer magnetic leg to be different from that of the coil of the second outer magnetic leg. In regard to the winding position, it is not essential to wind the entire coil around the outer magnetic leg, but a part of the coil may be wound around the rod-shaped connecting core The adjustment of directionality may be performed by setting at least one of a cross-sectional area and the angle θ of the first outer magnetic leg to be different from that of the second outer magnetic leg. Further, the rod-shaped connecting core may be omitted, and the outer magnetic legs may be directly connected together at a single position in a V or U-shaped pattern. The directional bar-type antenna according to the above embodiments may be configured to adjustably change the winding position of each of the coils and/or the angle θ of each of the outer magnetic legs so as to adjust directionality.

Figure 24:
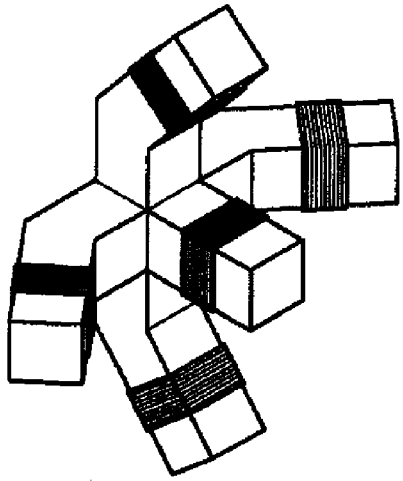
FIG. 24 is a perspective view showing a directional bar-type antenna according to a third embodiment of the present invention.
Figure 25:
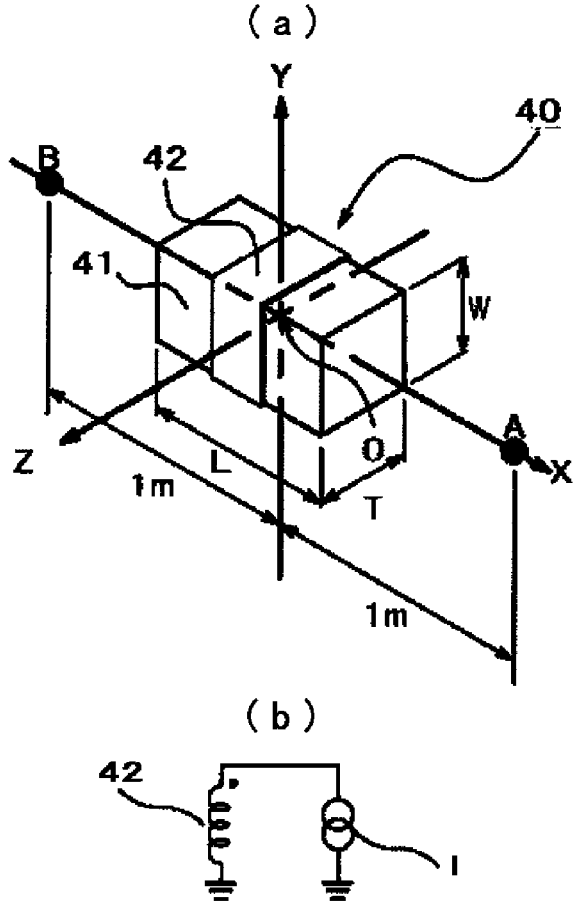
FIG. 25 is a perspective view showing a conventional bar-type antenna.
Figure 26:
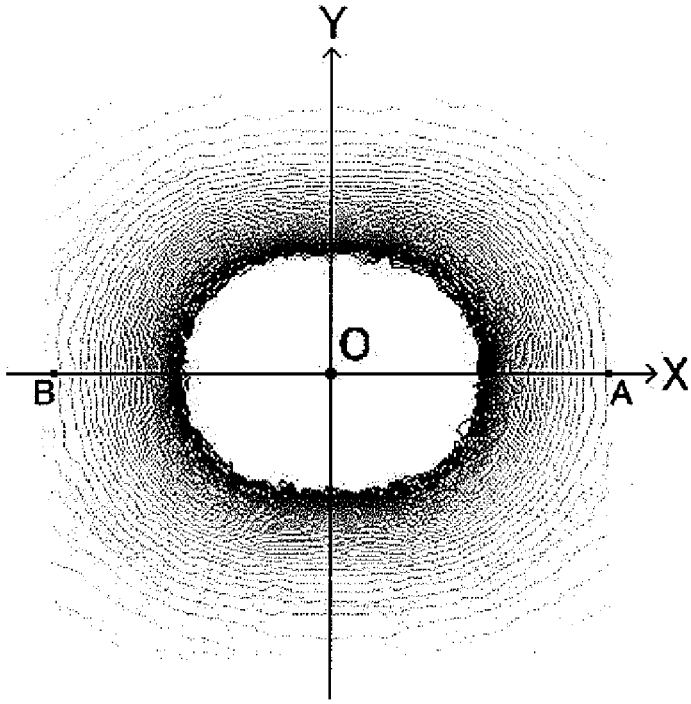
FIG. 26 is a graph showing a magnetic field intensity distribution in the conventional bar-type antenna.
Figure 27:
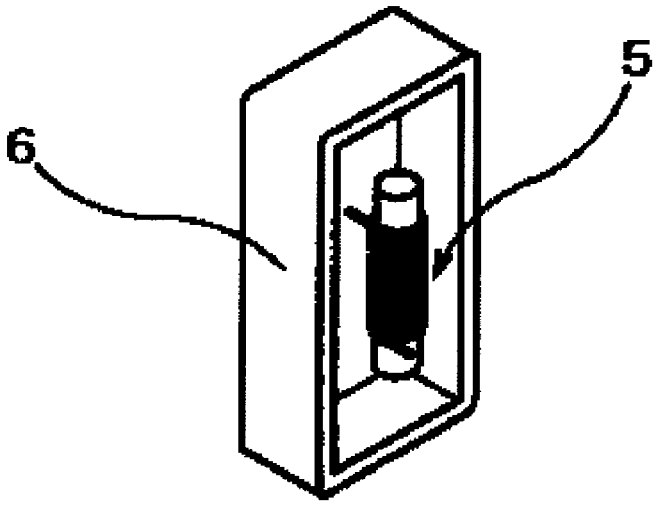
FIG. 27 is a perspective view showing one example of a technique for providing directionality to the conventional bar-type antenna.

FIG. 24 is a perspective view showing a directional bar-type antenna according to a third embodiment of the present invention. As shown in FIG. 24, this directional bar-type antenna comprises: a cross-shaped connecting core, an inner magnetic leg (bar-shaped inner core) protruding from an intersecting portion of the cross-shaped connecting core; two pairs of outer magnetic legs (bar-shaped outer cores) each of the pairs of which are symmetrically arranged with respect to the inner magnetic leg, wherein the pairs of outer magnetic legs protrude from respective ones of four distal ends of the cross-shaped connecting core, toward the same side as that of the inner magnetic leg in a radial pattern; and four coils each wound around a respective one of the inner magnetic leg and the outer magnetic legs in such a manner that a wounding direction of one of each of the pairs of outer magnetic legs is set to be opposite to that of the inner magnetic leg. In the third embodiment, directionality can be three-dimensionally obtained.

What is claimed is:

1. A directional bar-type antenna, comprising:

a plurality of bar-shaped antenna elements including a core and a coil wound around the core, wherein a first bar-shaped antenna element of the plurality is disposed at a position of a mirror image of a second bar-shaped antenna element of the plurality with respect to the core of a third bar-shaped antenna element of the plurality;

wherein the first and second bar-shaped antenna elements are positioned such that one end of each of the first and second bar-shaped antenna elements is proximate the third bar-shaped antenna element, and the other end of each of the first and second elements is remote from the third bar-shaped antenna element; and wherein a winding direction of the coil of the first bar-shaped antenna element is identical to the winding direction of the coil of the second bar-shaped antenna element, and is opposite to the winding direction of the coil of the third bar-shaped antenna element.

2. The directional bar-type antenna as defined in claim 1, wherein said one end of each of the first and second bar-shaped antenna elements is connected by a rod-shaped connecting core to an end of the third bar-shaped antenna element on a same side as said one end.

3. The directional bar-type antenna as defined in claim 2, wherein an angle between the third bar-shaped antenna element and each of the first and second bar-shaped antenna elements is adjustable.

4. The directional bar-type antenna as defined in claim 1, wherein an angle between the third bar-shaped antenna element and each of the first and second bar-shaped antenna elements is adjustable.

* * * * *